US005409058A

United States Patent [19]

Yuasa et al.

[11] Patent Number: 5,409,058

[45] Date of Patent: Apr. 25, 1995

[54] HEAT EXCHANGING APPARATUS

[75] Inventors: Munenori Yuasa; Shinichi Hamada, both of Anjo; Yasutoshi Yamanaka, Kariya, all of Japan

[73] Assignee: Nippondenso Co., Ltd., Kariya, Japan

[21] Appl. No.: 181,080

[22] Filed: Jan. 13, 1994

[30] Foreign Application Priority Data

Jan. 14, 1993 [JP] Japan ..... 5-004436
Nov. 16, 1993 [JP] Japan ..... 5-286732

[51] Int. Cl.[6] ..... F28F 3/08
[52] U.S. Cl. ..... 165/167; 165/140
[58] Field of Search ..... 165/166, 167, 140

[56] References Cited

U.S. PATENT DOCUMENTS

| | | | |
|---|---|---|---|
| 2,528,013 | 10/1950 | Morris | 165/167 |
| 4,624,305 | 11/1986 | Rojey | 165/165 |
| 5,016,707 | 5/1991 | Nguyen | 165/167 |
| 5,063,995 | 11/1991 | Forster et al. | 165/166 |
| 5,193,611 | 3/1993 | Hesselgreaves | 165/165 |

FOREIGN PATENT DOCUMENTS

| | | | |
|---|---|---|---|
| 648513 | 1/1989 | Japan . | |
| 2162630 | 2/1986 | United Kingdom | 165/166 |

*Primary Examiner*—John Rivell

*Assistant Examiner*—L. R. Leo

*Attorney, Agent, or Firm*—Cushman, Darby & Cushman

[57] ABSTRACT

An oil cooler includes a heat exchanging core 40 which includes a stack of heat exchanging plates 40. Each of the heat exchanging plates 40 includes a first set of openings 61 and 62 and a second set of openings 65, 66 and 67. The openings 65, 66 and 67 in the second set construct rows which are spaced along the width W of the plates 40. The openings between the first and second sets are alternately arranged along a direction of the width W of the plates. The openings 61 and 62 in the first set are symmetrical about a central axis X—X, while the openings 65, 66 or 67 in each row are asymmetric about the axis X—X. The stack of the plates 40 is such that the plates are alternately reversed, so that the symmetrical openings 61 and 62 are in communication with each other in the stack to created a first passageways 63 and 64 in the direction transverse to the plane of the plates 40 for the water, and so that the asymmetrical openings 65, 66 and 67 are in communication with each other in the stack to created a second passageways 68, 69 and 70 in the direction parallel to the plane of the plates. The plates 40 are provided with partitions 220 and 222 for dividing the second passageways into the groups 68, 69 and 70 for different oils.

9 Claims, 15 Drawing Sheets

HEAT EXCHANGING APPARATUS

BACKGROUND OF THE INVENTION

1. Field of the Invention

The present invention relates to a heat exchanging device adapted to be, for example, used for an oil cooler using engine cooling water for cooling different kinds of oils, for various lubrication and other operational purposes in an automobile, such as engine oil, transmission oil and power steering oil.

2. Description of Related Art

In an automobile, various kinds of oils, such as engine oil, transmission oil, and power steering oil are used. Various types of oil coolers have been used for obtaining exclusive cooling of these oils, which causes spaces occupied thereby to increase irrespective of a limited available space in an engine compartment of an automobile, on one hand, and the increased cost due to the necessity for additional parts well as additional assembling steps, on the other hand.

In order to obviate these problems, a Japanese Un-Examined Utility Model Publication No. 64-8513 discloses an oil cooler which includes a pair of cooling units arranged in a side-by-side relationship for separately cooling different kinds of oils, while an engine cooling water is commonly used as a cooling medium for both of the cooling units. Each unit has a stack of heat exchanging plates, between adjacent water passageways for a flow of cooling water and oil passageways for flows of oils are alternately created. A separation plate is arranged between the adjacent water passageways of the first and second cooling units for separating the flows of the two kinds of oils. A cooling fin is arranged in each of the oil passageways. This prior art is, however, defective in that its construction is complicated in view of a necessity of special parts, such as a partition wall for separating the water passageways between the first and second heat exchanging units.

SUMMARY OF THE INVENTION

An object of the present invention is to provide a heat exchanging device, capable of reducing the number of parts constructing the device as well as steps for making it, thereby reducing its production cost.

Another object of the present invention is to provide a heat exchanging device, capable of eliminating a separate part for obtaining separate flows of different media to be cooled.

Further another object of the present invention is to provide an oil cooler capable of obtaining an increased heat exchanging efficiency between an engine cooling water and different kinds of oils.

According to the present invention, a heat exchanging device is provided, comprising:

a stack of heat exchanging plates, each having a first and second sets of openings;

said openings between said sets being arranged alternately along a direction in a plane of the plates;

said openings in said sets being in communication with each other between the stacked plates for creating first and second heat exchanging passageways, respectively, which are separated from each other;

said first heat exchanging passageways extending substantially transverse to the plane of the heat exchanging plates, while the second heat exchanging passageways extending substantially parallel to the plane of the heat exchanging plates;

one of the first and second heat exchanging passageways being for a passage of a cooling medium, while the other heat exchanging passageway being for a passage of a plurality of media to be subjected to a heat exchange with the cooling medium;

each of heat exchanging plates being provided with spaced partitions for dividing said heat exchanging passageway for the passage of the media to be cooled into separate groups, so that the media to be cooled separately flow in the respective groups.

According to the second aspect of the invention, a heat exchanging device is provided, comprising:

a stack of heat exchanging plates, each having a first and second sets of openings;

said openings between said sets being arranged alternately along a direction in a plane of the plates;

said openings in said sets being in communication with each other between said stacked plates for creating first and second heat exchanging passageways, respectively which are separate with each other;

said first heat exchanging passageways extending substantially transverse to the plane of the heat exchanging plates for a passage of a cooling medium, while the second heat exchanging passageways extending substantially parallel to the plane of the heat exchanging plates for passage of a plurality of media to be subjected to a heat exchange with the cooling medium;

each of heat exchanging plates being provided with spaced partitions for dividing said second heat exchanging passageway for the passage of the media to be cooled into separate groups, so that the media to be cooled separately flow in the respective groups.

BRIEF DESCRIPTION OF ATTACHED DRAWINGS

DESCRIPTION OF PREFERRED EMBODIMENTS

Figure 1:
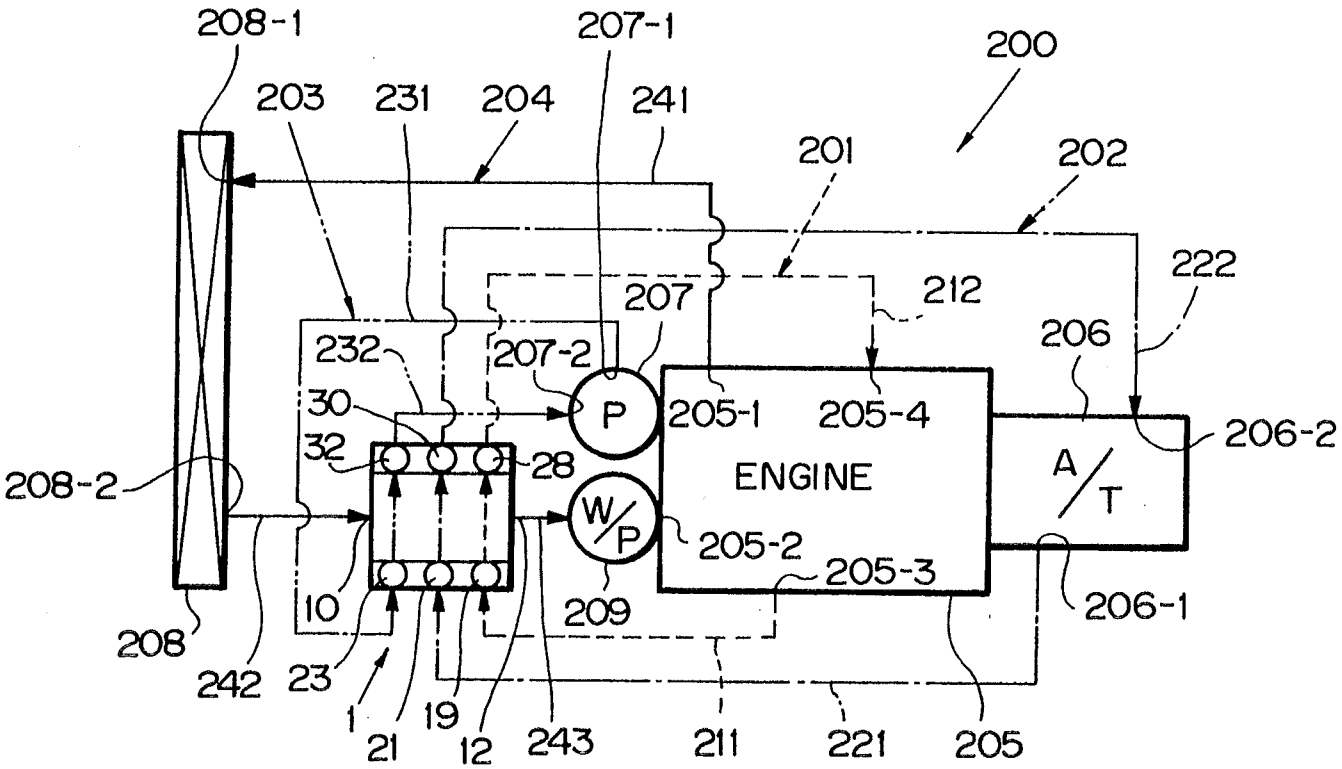
FIG. 1 is a schematic diagrammatic view of an internal combustion engine provided with an oil cooler according to the present invention.

A first embodiment of the present invention will now be explained with reference to FIGS. 1 to 11. FIG. 1 schematically shows an arrangement of parts in an engine room of an automobile. Namely, reference numeral 205 denotes an internal combustion engine of a water-cooled type having a radiator 208. In a well known manner, an automatic transmission device 206 is connected to a crankshaft (not shown) of the engine, on one hand, and drive wheels, on the other hand. The automobile is further provided with a power steering device including an oil pump 207 connected to the crankshaft of the engine. Reference numeral 209 is a water pump, also connected to the crankshaft, for a positive recirculation of the engine cooling water between the engine 205 and the radiator 208. Namely, a cooling water circuit 204 is provided, which includes a cooling water introduction passageway 241 for connecting a water outlet 205-1 of the engine with a water inlet 208-1 of the radiator 208 and a cooling water return passageway 242 for connecting an outlet 208-2 of the radiator 208 with an inlet of the water pump 209, which is, at its outlet, connected to an inlet 205-2 of the engine body 205.

In FIG. 1, a reference numeral 200 generally denotes an oil cooling system according to the first embodiment. The cooling system 200 includes first, second and third cooling circuits 201, 202 and 203. The first oil cooling circuit 201 is for a recirculation of an engine oil (below; a first oil) of a high temperature after the lubricating portions of the internal combustion engine 205 to be lubricated. Namely, the first oil from the engine 205 is introduced into an oil cooler 1 via the first circuit 201. The first circuit 201 is constructed by a first oil introduction passageway 211 for introducing the high temperature oil from the engine 205 into the oil cooler 1 via its first oil inlet pipe 19, and a first oil return passageway 212 for returning, from its first outlet 28, the oil after being cooled at the oil cooler 1 to the internal combustion engine 205. The engine is provided with an oil outlet 205-3 for passing the oil from the engine into the passageway 211, and an oil inlet 205-4 for introduction of the oil from the passageway 212.

The second oil cooling circuit 202 is for recirculating a transmission oil (below; second oil) after lubrication of various parts of the transmission 206 and for introducing the oil cooled by the oil cooler 1 into the transmission 206. Namely, the second oil cooling circuit 202 includes a second oil introduction passageway 221 connected to an oil outlet 206-1 of the transmission 206 for passing the high temperature oil from the transmission to a second oil inlet pipe 21 of the oil cooler 1 and a second oil returning passageway 212 for introduction of the oil from a second oil outlet 30 to an oil inlet 206-2 of the transmission 206.

The third cooling circuit 203 is for recirculating a power steering oil (below; third oil) after lubricating the power steering system and for re-introducing the power steering oil after being cooled by the oil cooler 1 to the power steering. Namely, the third cooling circuit 203 includes a third oil inlet passageway 231 for passing oil from an outlet 207-1 of the power steering oil pump 207 to a third oil inlet pipe 23 of the oil cooler 1 and a third oil returning passageway 232 for introducing the oil cooled at the oil cooler 1, from its third oil outlet 32, to an inlet 207-2 of the steering oil pump 207.

As shown in FIG. 1, the water cooler 1 is arranged on the cooling water passageway 242 from the radiator 208 to the water pump 209, so that the water from the outlet 208-2 of the radiator is introduced into the oil cooler 1 at its water inlet pipe 10, and so that the engine cooling water after heat exchange at the oil cooler 1, is discharged from it outlet pipe 12 to the water pump 209. In other words, at the oil cooler 1, a heat exchange occurs between the engine cooling water after being cooled at the radiator 208 and the oils from the first, second and third oil cooling circuits 201, 202 and 203, as will be fully described later.

Figure 2:
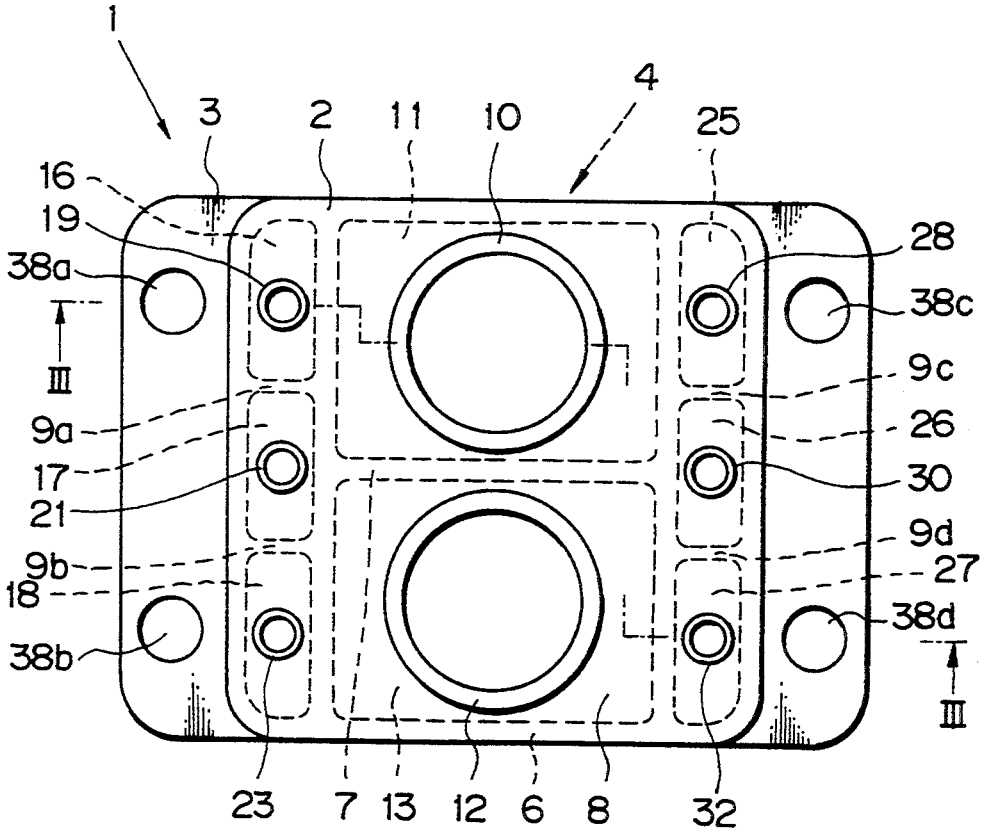
FIG. 2 is a plan view of the oil cooler in FIG. 1.
Figure 3:
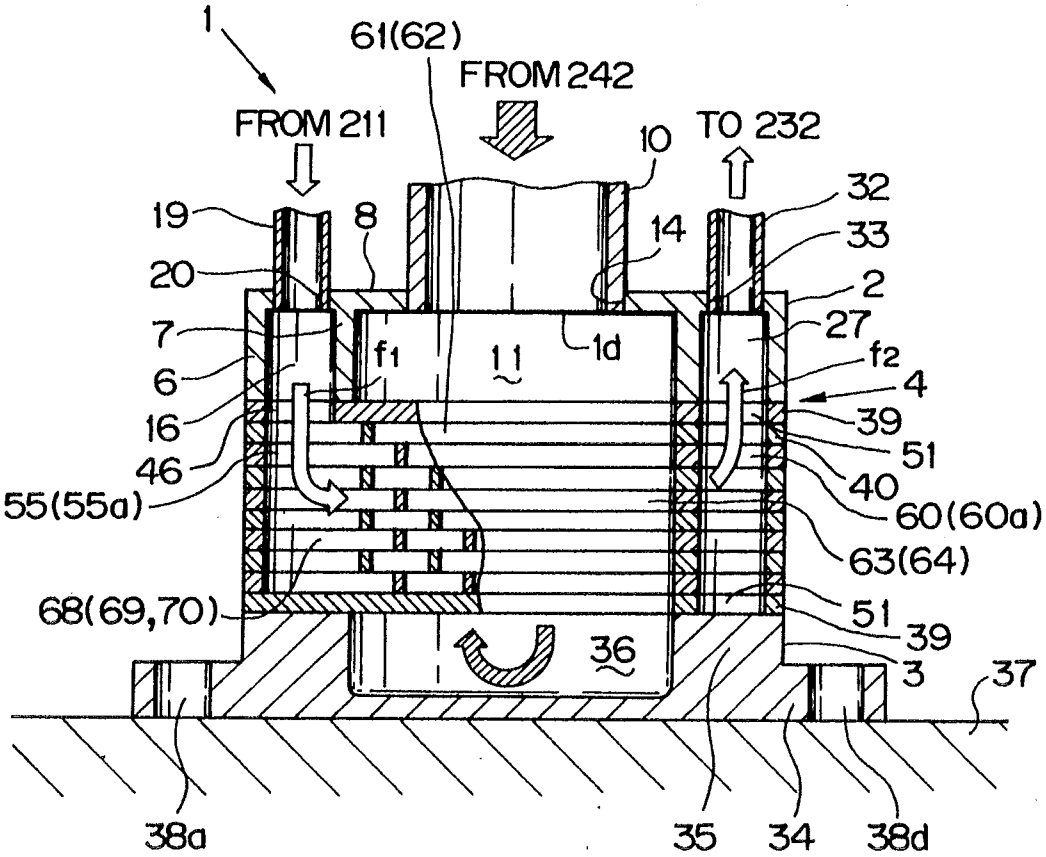
FIG. 3 is a cross sectional view along a line VI—VI in FIG. 2.
Figure 4:
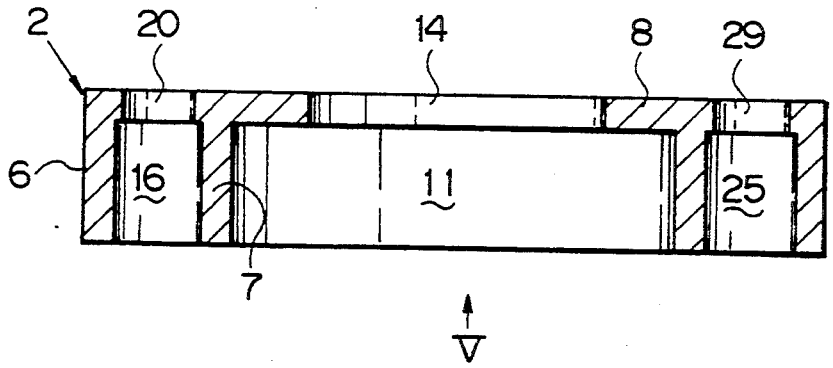
FIG. 4 is similar to FIG. 3 but shows only the first bracket.
Figure 5:
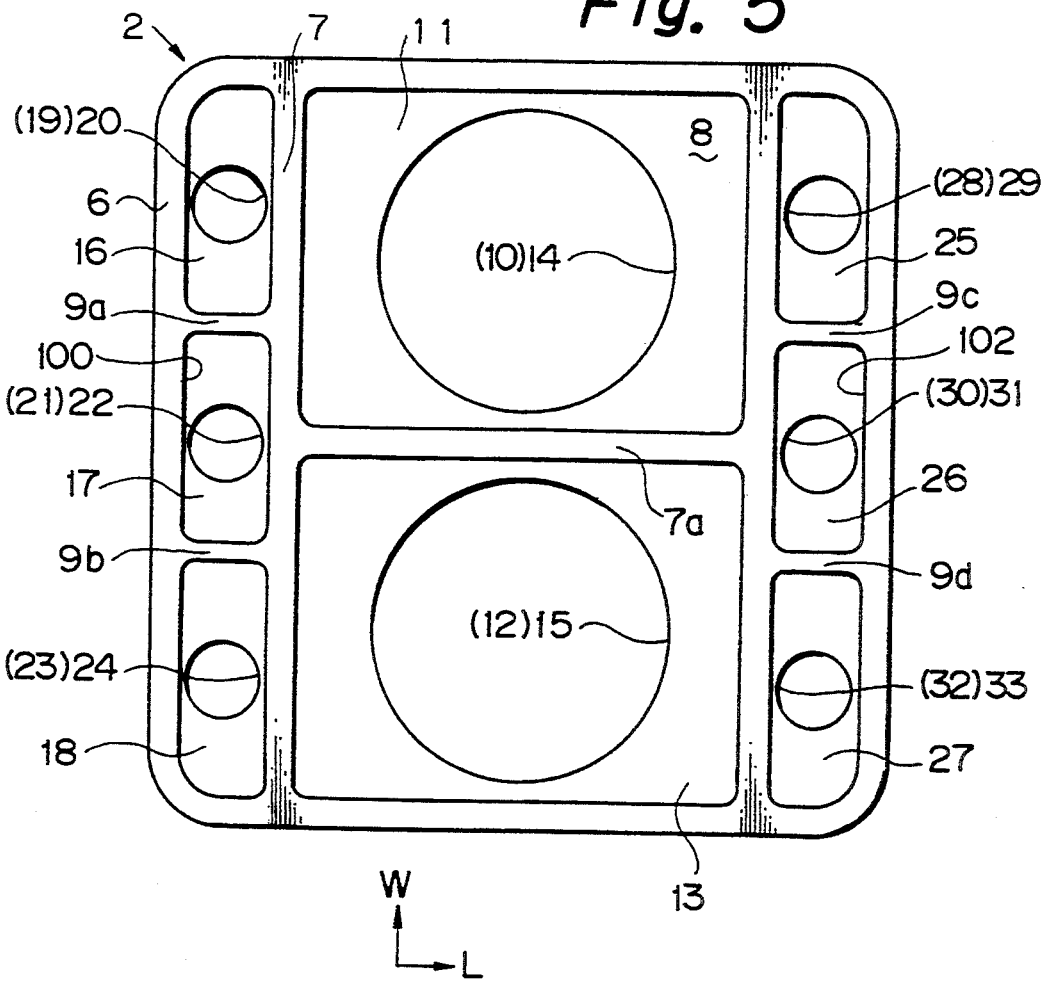
FIG. 5 is a bottom side view of the first bracket taken along an arrow V in FIG. 4.

Now, a detail construction of the water cooling type oil cooler 1 will be explained with reference to FIGS. 2 to 11. As shown in FIGS. 2 and 3, the oil cooler 1 includes a first and a second brackets 2 and 3, and a heat exchanging unit 4 for obtaining a heat exchange of the engine cooling water with the first, the second and the third oils. The first bracket 2 is made from a flat, metal plate, such as a aluminum based alloy plate of thickness of 1.5 mm, and is connected to an upper end of the heat exchanging unit 4 by means of a soldering. As shown in FIGS. 4 and 5, the first bracket 2 is generally formed as a downwardly directed shell shape having an outer side wall 6 of substantially "O" cross sectional shape, an inner wall 7 connected to the outer side wall 6 and of substantially "H" cross sectional shape, a top wall 8 connected to the outer and inner side walls 6 and 7 at their top ends in such a manner that, between the inner walls 6 and 7, a pair of elongated rectangular recess 100 and 102 opened at its bottom are created, which are spaced along the length L of the bracket. Partition walls **9*a* and 9*b* are provided for connecting faced surfaces of the inner and outer side walls 6 and 7, so that the elongated recess 100 at the bottom of the first bracket 2 is divided into three rectangular recess, and partition walls 9*c* and 9*d* are provided for connecting faced surfaces of the inner and outer side walls 6 and 7, so that the elongated recess 102 at the bottom of the first bracket 2** is divided into three rectangular recess.

As shown in FIG. 5, the inner wall 7 includes a partition **7*a*, which creates a pair of rectangular shaped recess, which, together with an upper wall of the heat exchanging unit 4, forms a cooling water inlet chamber 11 to which a cooling water introduction pipe 10 is connected, and a cooling water outlet chamber 13 to which a cooling water discharge pipe 12 is connected for discharge of the engine cooling water after heat exchange to the water pump 209 in FIG. 1. Namely, as shown in FIG. 5, the cooling water inlet chamber 11 and the cooling water outlet chamber 13 are arranged in a side-by-side relationship along the width W of the first bracket 2, while these chambers 11 and 13 are partitioned by the wall 7*a*. To the pipe 10, a rubber hose constructing the cooling water passageway 242 in FIG. 1** is connected.

As shown in FIG. 3, the top wall 8 of the first bracket 2 forms an opening 14 opened to the cooling water inlet chamber 11, to which opening 14 the engine cooling water inlet pipe 10 is inserted and fixed by a suitable means. Similarly, the top wall 8 of the first bracket 2 forms an opening 15 opened to the cooling water outlet chamber 13, to which opening 15 the engine cooling water outlet pipe 12 is inserted and fixed by a suitable means. To the pipe 12, a rubber hose constructing the cooling water passageway 243 in FIG. 1 is connected.

As already explained with reference to FIGS. 4 and 5, on one side of the first bracket 2 along the length L thereof, the elongated recess 100 is divided to three sections by the partitions 9*a* and 9*b*, which sections forms, together with the heat exchanging unit 4, a first oil inlet chamber 16 of substantially rectangular shape, a second oil inlet chamber 17 of substantially rectangular shape, and a third oil inlet chamber 18. These chambers 16, 17 and 18 are arranged side-by-side along the width W of the first bracket 2. As shown in FIGS. 3 to 5, the top wall of the first bracket 2 is formed with an opening 20 opened to the first oil inlet chamber 16, to which opening 20, a first oil inlet pipe 19 is inserted and fixed by any suitable means. To the pipe 19, a rubber hose constructing the first oil inlet passageway 211 is connected. Similarly, the top wall of the first bracket 2 is formed with an opening 22 opened to the second oil inlet chamber 17, to which opening 22, a second oil inlet pipe 21 is inserted and fixed by any suitable means. To the pipe 21, a rubber hose constructing the second oil inlet passageway 221 is connected. Furthermore, the top wall of the first bracket 2 is formed with an opening 24 opened to the third oil inlet chamber 18, to which opening 24, a third oil inlet pipe 23 is inserted and fixed by any suitable means. To the pipe 23, a rubber hose constructing the second oil inlet passageway 231 is connected.

In FIGS. 4 and 5, on the other side along the length L of the first bracket 2, the elongated recess 102 is divided to three sections by the partitions 9*c* and 9*d*, which sections form, together with the heat exchanging unit 4, a first oil outlet chamber 25 of substantially rectangular shape, a second oil outlet chamber 26 of substantially rectangular shape, and a third oil inlet chamber 27 of substantially rectangular shape. These chambers 25, 26 and 27 are arranged side-by-side along the width W of the first bracket 2. As shown in FIGS. 2 to 5, the top wall of the first bracket 2 is formed with an opening 29 opened to the first oil outlet chamber 25, to which opening 29, a first oil outlet pipe 28 is inserted and fixed by any suitable means. To the pipe 28, a rubber hose constructing the first oil outlet passageway 212 is connected. Similarly, the top wall of the first bracket 2 is formed with an opening 31 opened to the second oil outlet chamber 26, to which opening 31, a second oil outlet pipe 30 is inserted and fixed by any suitable means. To the pipe 30, a rubber hose constructing the second oil outlet passageway 222 is connected. Furthermore, the top wall of the first bracket 2 is formed with an opening 33 opened to the third oil outlet chamber 27, to which opening 33, a third oil outlet pipe 32 is inserted and fixed by any suitable means. To the pipe 32, a rubber hose constructing the second oil outlet passageway 232 is connected.

Figure 6:
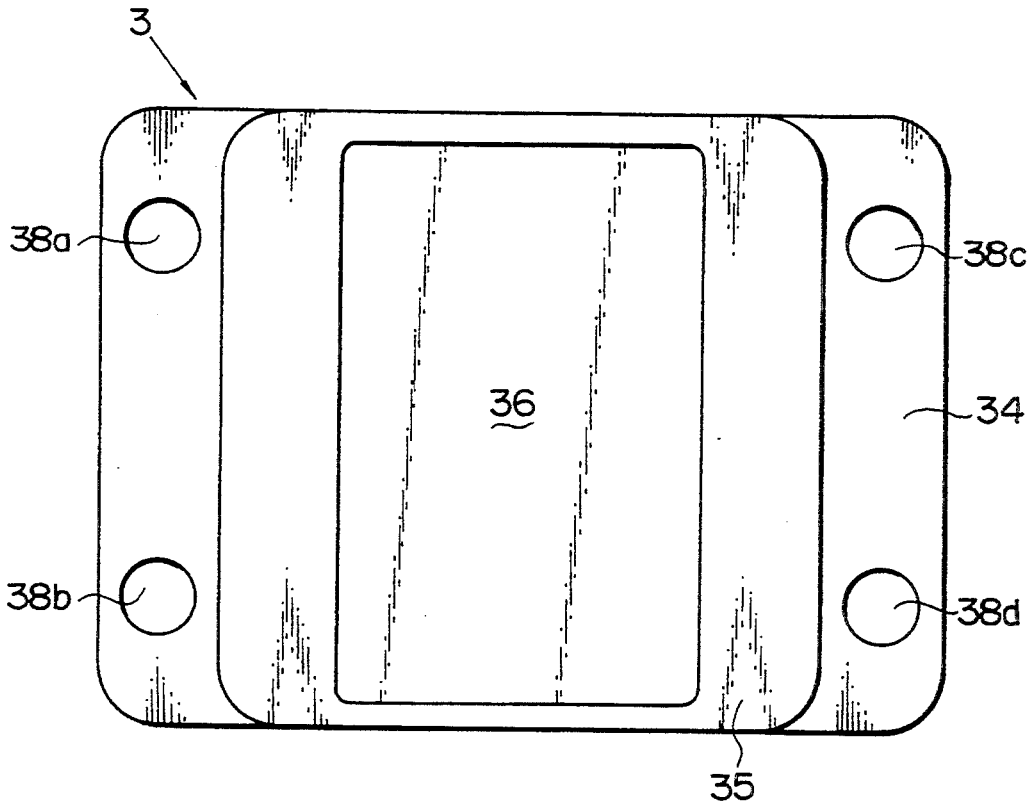
FIG. 6 is a plan view of a second bracket in FIG. 3.
Figure 7:
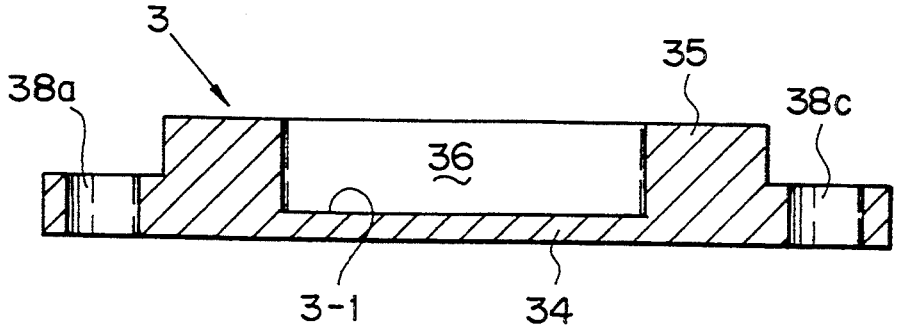
FIG. 7 is a cross sectional view of the second bracket in FIG. 6.

In FIGS. 3 and 7, the second bracket 3 is formed from a metal flat plate, such as an aluminum based alloy plate of thickness of 4.5 mm, and is fixedly connected to the lower side of the heat exchanging unit 4. As shown in FIGS. 6 and 7, the second bracket 3 is formed with a base plate portion 34 of thickness of, for example, 3 mm, and a projected portion 35 of substantially "O" cross sectional shape of thickness of, for example, 4.5 mm. This projected portion 35 functions as a closure for preventing the first, second and third oils from flowing downwardly. Formed inwardly of the projected portion 35 is a recess 3-1, which, together with the heat exchanging unit 4, forms a cooling water communication chamber 36, through which the cooling water from the cooling water inlet chamber 11, after heat exchange with the flows of the oils, is introduced. The second bracket 3 is, at its corner portions, formed with bores 38*a*, 38*b*, 38*c* and 38*d*, which are for introduction of bolts, which are screwed to a suitable member 37 (FIG. 3) of the block of the internal combustion engine.

The heat exchanging unit 4 is constructed by upper and lower oil-water separation plates 39 and a stack of alternately reversed heat exchanging plates 40 between the top and bottom oil-water separation plates 39. As a result, cooling of the oils by means of the engine cooling water occurs as will be explained later.

Figure 8:
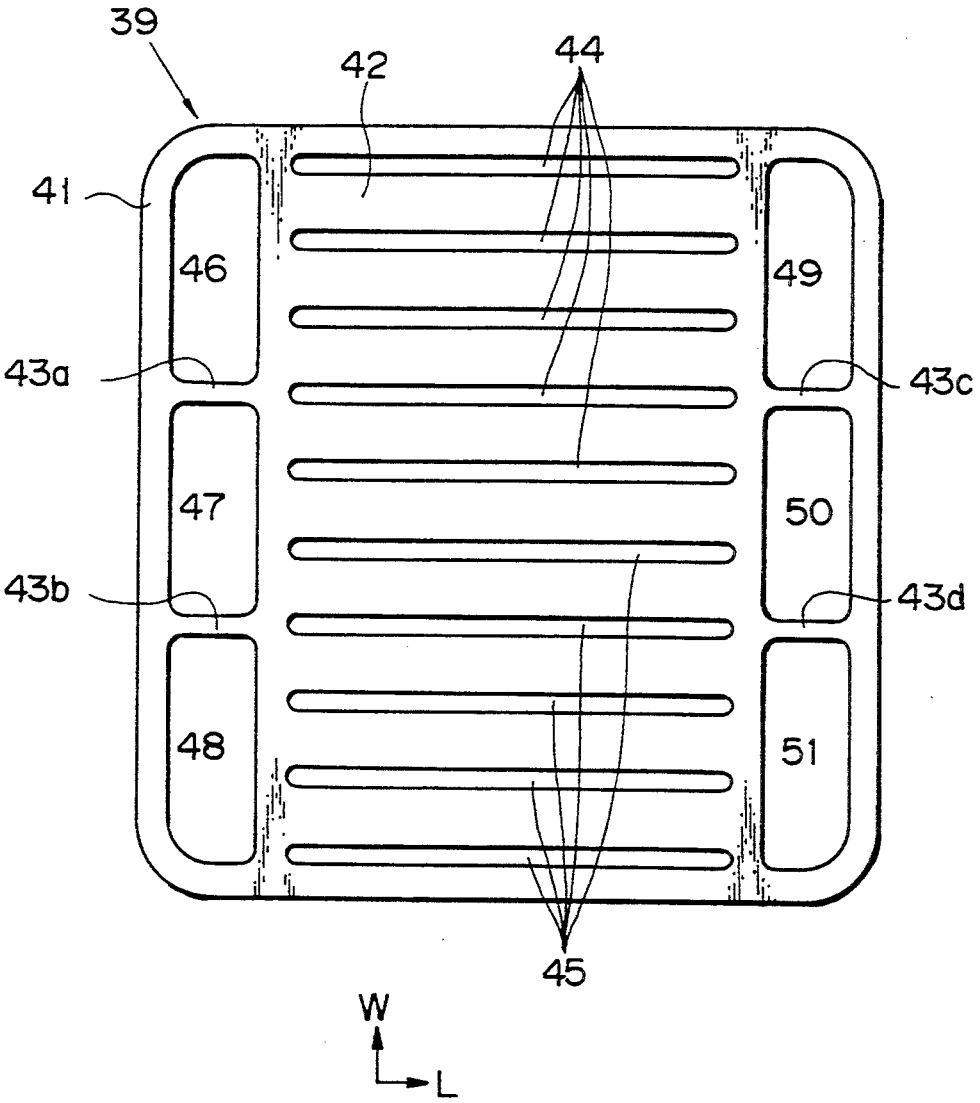
FIG. 8 is a plan view of a water-oil separation plate in FIG. 3.

Each of the oil-water separation plates 39 is formed from a plane metal plate such as an aluminum based alloy plate of thickness of, for example, 0.8 mm. As shown in FIG. 3, the upper and lower oil-water separation plates 39 are connected to the upper and lower ends of the stack of the heat exchanging plates 40 by means of a suitable means, such as a soldering. As shown in FIG. 8, each of the oil-water separation plates 39 is formed with an outer wall portion 41 of substantially "O" shape, a oil-water separation portion 42 divided to a plurality of parallel groups or sections for separating the flows of the first, second and third oils from the flow of the engine cooling water, and separation walls 43*a*, 43*b*, 43*c* and 43*d* for dividing the openings between the outer wall portion 41 and the oil-water separation portion 42 into a plurality of groups or sections. Namely, the oil-water separation portion 42 is formed with five parallel elongated openings 44 along the length L, which are for communication between the cooling water inlet chamber 11 and the cooling water communication chamber 36 for downwardly directed flow of the water in FIG. 3, and five parallel elongated openings 45, which are for communication between the communication chamber 36 and the cooling water outlet chamber 13 for upwardly directed flows of the water. These openings 44 and 45 are elongated along the length L of the plate 39 and are parallel along the width W of the plate.

As shown in FIG. 8, on one side of the length L of the plate 39, i.e., the left-handed side in FIG. 8, due to the provision of the partition walls 43*a* and 43*b*, a first oil inlet opening 46 which is in communication with the first oil inlet chamber 16, a second oil inlet opening 47 which is in communication with the second oil inlet chamber 17, and a third oil inlet opening 48 which is in communication with the third oil inlet chamber 18 are created, so that these openings 46, 47 and 48 are divided by the partitions 43*a* and 43*d* along the width of the plate 39.

On the opposite side of the length of the plate 39, i.e., the right-handed side in FIG. 8, due to the provision of the partition walls 43*c* and 43*d*, a first oil outlet opening 49 which is in communication with the first oil outlet chamber 25, a second oil outlet opening 50 which is in communication with the second oil outlet chamber 26, and a third oil outlet opening 51 which is in communication with the third oil outlet chamber 27 are created, so that these openings 49, 50 and 51 are divided by the partitions 43*c* and 43*d* along the width of the plate 39.

The heat exchanging plates 40 constructing the stack are, each, made from a rectangular shaped metal plate of, for example, aluminum alloy plate of thickness of 0.8 mm, and are fixed with each other by a suitable means such as soldering.

Figure 9:
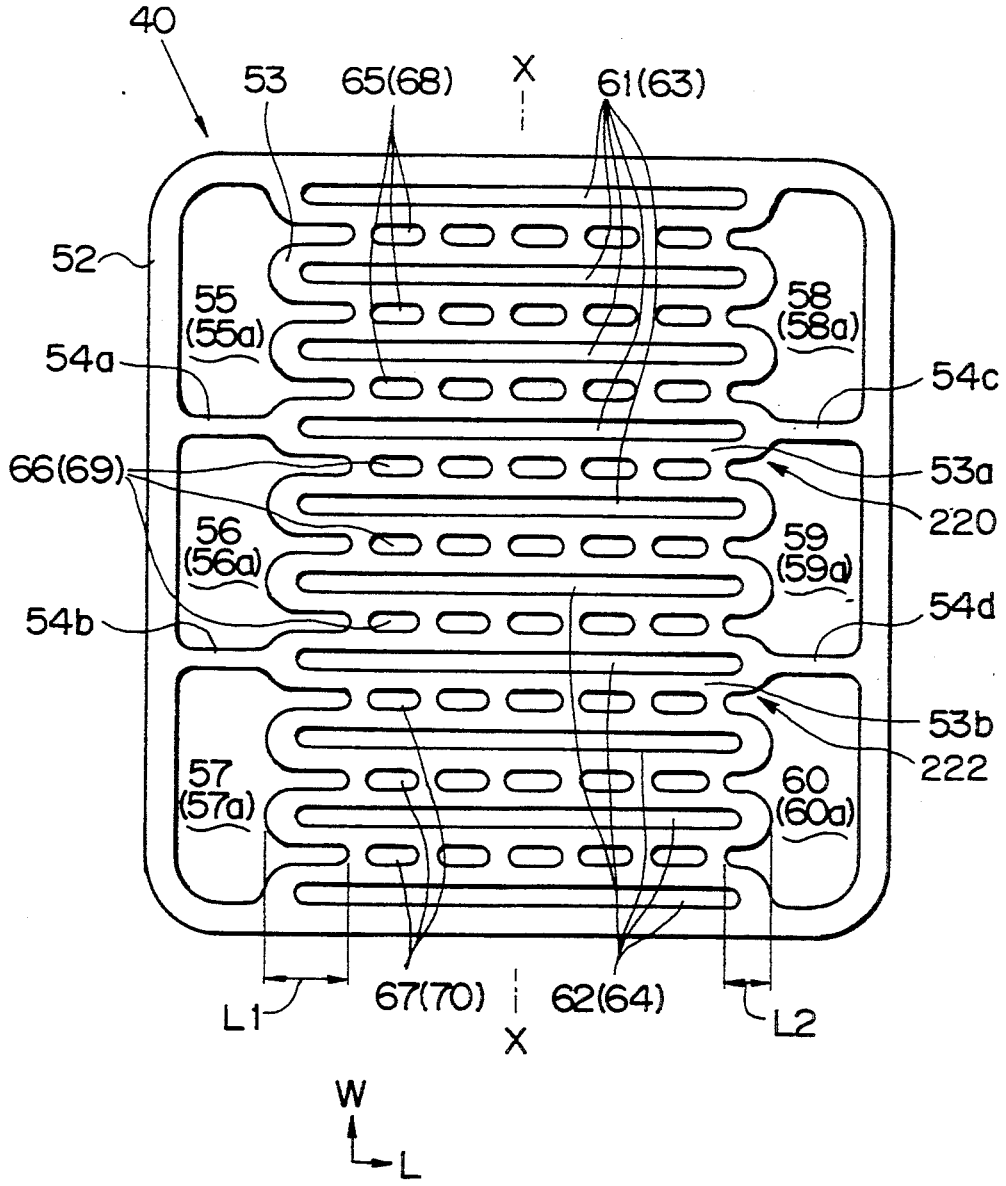
FIG. 9 is a plan view of a heat exchanging plate in FIG. 3.

Each of the heat exchanging plates 40 is, as shown in FIG. 9, constructed by: an outer peripheral wall portion 52 of substantially "O" shape; an oil-water separation wall 53 extending along the width W of the plate 40 and having opposite ends spaced along the length L of the plate 40 of corrugated shape, the corrugated shape on the one end (left hand side in FIG. 9) having a length $L_1$ which is longer than the length $L_2$ of the corrugated shape on the other side (right hand side in FIG. 9), and; four partition walls 54*a*, 54*b*, 54*c* and 54*d* which divide spaces formed between the peripheral wall 52 and the central wall 53.

On the one of the sides of the heat exchanging plate (left hand side of FIG. 9), the opening formed by the peripheral wall 52 and the central wall 53 is divided, by means of the partition walls 54*a* and 54*b*, into a first oil inlet opening 55, which is in communication with the first oil inlet 46 (FIG. 8) of the oil-water separation plate 39, a second oil inlet opening 56, which is in communication with the second oil inlet opening 47 of the plate 39, and a third oil inlet opening 57, which is in communication with the third inlet opening 48 of the plate 39. These openings 55, 56 and 57 are arranged parallel along the width W of the plate 40.

On the other side of the heat exchanging plate (right hand side of FIG. 9), the space formed by the peripheral wall 52 and the central wall 53 is divided, by means of the partition walls 54*c* and 54*d*, into a first oil outlet opening 58, which is in communication with the first oil outlet 49 (FIG. 8) of the oil-water separation plate 39, a second oil outlet opening 59, which is in communication with the second oil outlet opening 50 of the plate 39, and a third oil outlet opening 60, which is in communication with the third inlet opening 51 of the plate 39. These openings 58, 59 and 60 are arranged parallel along the width of the plate 40.

It should be noted that, these partition walls 54*a* and 54*b* and 54*c* and 54*d* are formed symmetrical about the central axis X—X along the width of the plate 40. Thus, the stack of alternately reversed plates 40 as shown in FIG. 3 permits the opening 55 and 58, 56 and 59, and 57 and 60, to be aligned with each other, respectively between each adjacent reversed pair of the plates 40, so that first oil incoming and outgoing, vertical passageways 55*a* and 58*b*, second oil incoming and outgoing, vertical passageways 56*a* and 59*a*, and third oil incoming and outgoing, vertical passageways 57*a* and 57*b* are created, so that flows of the first, second and third oils are allowed along the passageways 55*a* and 58*a*, 56*a* and 59*a*, and 57*a* and 60*a*, while preventing the first, second and third oils from being mixed with each other.

Furthermore, the separation wall portion 53 of the plate 40 is, at its one side along the width W thereof, formed with five parallel elongated openings 61 along substantially the full length of the portion 53, which are respectively in communication with the elongated openings 44 in the plate 39 in FIG. 8, so that incoming flows of the cooling water along the downward direction in FIG. 3 is obtained. Furthermore, the separation wall portion 53 is, at its other side along the width W thereof, formed with five parallel elongated openings 62 along substantially full length of the portion 53 which are respectively in communication with the elongated openings 45 in FIG. 8, so that flows of the outgoing cooling water along the upward direction in FIG. 3 is obtained. These openings 61 and 62 are formed symmetrical about the central axis X—X. When the stack construction of these plates 40 is obtained, the openings 61, which are aligned with each other, form a passageway 63 for a flow of incoming water, while the openings 61, which are aligned with each other, form a passageway 64 for a flow of outgoing water.

As shown in FIG. 9, on one side of the plate (upper side in FIG. 9), along the width W of the plate 40, between each of the adjacent incoming water openings 61, spaced rows of first oil communication openings 65 of substantially elliptic shape are arranged along the length L of the plate 40. In each of the rows, the arrangement of the openings 65 is asymmetric with respect to the central axis X—X. A first group constructed by three such rows of the openings 65 are provided for transmission of the first oil from the first oil inlet opening 55 to the first oil outlet opening 58.

On the middle portion of the plate 40 along the width of the plate 40, between each of the adjacent water passageways 61, a row of second oil communication openings 66 of substantially elliptic shape is arranged along the length L of the plate 40. In each of the rows, the arrangement of the openings 66 is asymmetric with respect to the central axis X—X. A second group of three such rows of the openings 66 are provided for transmission of the second oil from the second oil inlet opening 56 to the second oil outlet opening 59.

Furthermore, on the other side of the plate 40 (lower end of the plate 40 in FIG. 9), along the width W of the plate 40, between each of the adjacent water passageways 61, a row of third oil communication openings 67 of substantially elliptic shape is arranged along the length of the plate 40. In each of the rows, the arrangement of the openings 67 is asymmetric with respect to the central axis X—X. A third groups of three such rows of the openings 67 are provided for transmission of the third oil from the third oil inlet opening 57 to the third oil outlet opening 60.

It should be noted that, along the width of the plate 40, the openings 65, 66 and 67 between the rows are aligned to form respective columns. However, the arrangement of the columns is asymmetric with respect to the central axis X—X, due to the symmetric arrangement of the rows of the openings 65, 66 and 67, themselves.

Figure 10:
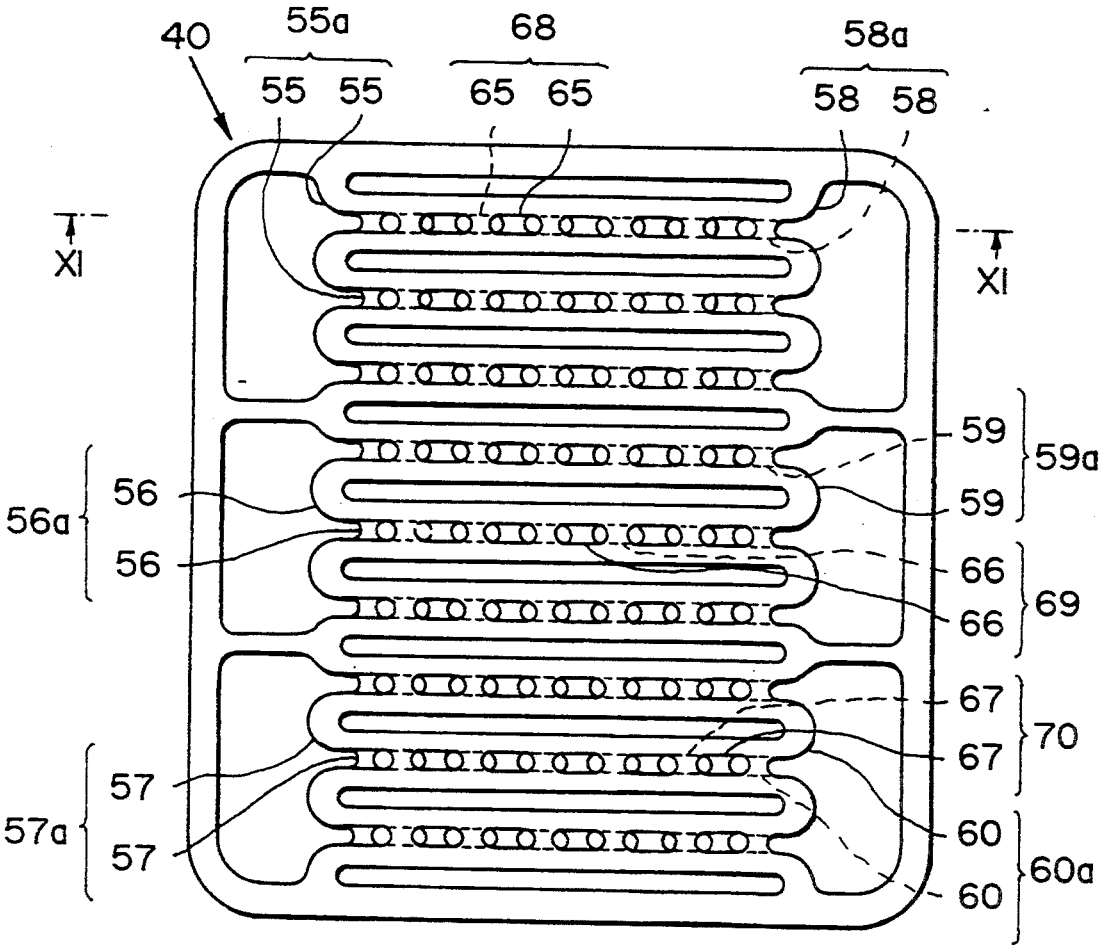
FIG. 10 is similar to FIG. 9, but shows a relationship between adjacent heat exchanging plates.

As above mentioned, the stack of the heat exchanging plates 40 along the vertical direction in FIG. 3 is such that the plates 40 are alternately reversed. Thus, the asymmetric arrangement of the openings 65, 66 and 67 with respect to the central axis X—X allows that, between the adjacent plates 40, the openings 65, 66 and 67 are slightly out of register. Namely, FIG. 10 is the same as FIG. 9, but solid line shows a heat exchanging plate 40, while dotted lines shows a vertically adjacent heat exchanging plate 40. As will be easily seen, the openings 65, 66 and 67 between the adjacent plates are out of register. Due to such an out of register arrangement, the openings 65, 66 and 67 form, along the respective rows, oil transmitting passageways 68, 69 and 70, respectively. For example, in FIG. 11, the openings 65 between the adjacent plates 40 are, in series, connected with each other for constructing a first oil transmitting passageway 68, which allows the first oil to be transmitted from the passageway 55*a* to the passageway 58*a* in a horizontal direction, i.e., in a direction parallel to the plane of the plates 40. Similarly, a transmission of second oil from the second oil inlet passageway 56*a* to the second oil outlet passageway 59*a* via the second oil transmitting passageway 69 constructed by the openings 66 is obtained in a horizontal direction, i.e., in a direction which is parallel to the plane of the plates 40. Similarly, a transmission of third oil from the third oil inlet passageway 57*a* to the third oil outlet passageway 60*a* via the third oil transmitting passageway 70 constructed by the openings 67 is obtained along a horizontal direction, i.e., a direction which is parallel to the plane of the plates 40.

Now, the oil cooler according to the first embodiment in FIGS. 1 to 11 will be explained. The first oil in the engine lubrication oil system from the first oil introduction pipe 19 is introduced, via an opening 20 in the first bracket 2, into the first oil inlet chamber 16. From the inlet chamber 16, the first oil is introduced, via the opening 46 in the separation plate 39, into the first oil inlet vertical passageway 55*a* constructed by the openings 59 of the stacked plates 40. The fist oil in the passageway 55*a* is, then, introduced into the first oil transmission passageways 68 formed by the openings 68 in the plates 40. The first oil in the passageway 68 is introduced into the first oil outlet vertical passageway 58*a* constructed by the openings 58 of the stacked plates 40. The oil in the passageway 58*a* is discharged, via the opening 49 in the separation plate 39, into the first oil outlet chamber 25. The oil in the chamber 25 is, via the opening 29 in the first bracket 2, discharged to the first oil outlet pipe 28, and is returned to the engine lubrication system.

The second oil in the transmission device 206 from the second oil introduction pipe 21 is introduced, via an opening 22 in the first bracket 2, into the second oil inlet chamber 17. From the inlet chamber 17, the second oil is introduced, via the opening 47 in the separation plate 40, into the second oil inlet vertical passageway 56*a* constructed by the openings 56 of the stacked plates 40. The second oil in the passageway 56*a* is, then, introduced into the second oil transmission passageways 69 formed by the openings 66 in the plates 40. The second oil in the passageway 69 is introduced into the second oil outlet vertical passageway 59*a* constructed by the openings 59 of the stacked plates 40. The oil in the passageway 59*a* is discharged, via the opening 50 in the separation plate 39, into the second oil outlet chamber 26. The oil in the chamber 26 is, via the opening 31 in the first bracket 2, discharged to the second oil outlet pipe 30, and is returned to the transmission device 206.

The third oil in the pump 207 for the power steering system from the third oil introduction pipe 23 is introduced, via an opening 24 in the first bracket 2, into the third oil inlet chamber 18. From the inlet chamber 18, the third oil is introduced, via the opening 48 in the separation plate 40, into the third oil inlet vertical passageway 57*a* constructed by the openings 57 of the stacked plates 40. The third oil in the passageway 57*a* is, then, introduced into the third oil transmission passageways 70 formed by the openings 67 in the plates 40. The third oil in the passageway 70 is introduced into the third oil outlet vertical passageway 60*a* constructed by the openings 60 of the stacked plates 40. The oil in the passageway 60*a* is discharged, via the opening 51 in the separation plate 39, into the third oil outlet chamber 27. The oil in the chamber 27 is, via the opening 33 in the first bracket 2, discharged to the third oil outlet pipe 32, and is returned to the power steering pump 207.

In FIG. 9, the middle partition wall 53 is provided with a portion 53*a* which extends along the length L of the heat exchanging plate 40 between the adjacent rows of the openings 65 and 66, and which is a substantially straight extension of the partition walls 54*a* and 54*c*, so that a oil separation wall 220 is created which separates the flows of the first and second oils from each other. The middle partition wall 53 is further provided with a portion 53*b* which extends along the length L of the heat exchanging plate 40 between the adjacent rows of the openings 66 and 67, and which is a substantially straight extension of the partition walls 54*b* and 54*d*, so as to form an oil separation wall 222 which separates the flows of the second and third oils from each other.

The engine cooling water in the radiator 208 from the cooling water introduction pipe 242 is introduced, via an opening 14 in the first bracket 2, into the cooling water inlet chamber 11. From the inlet chamber 11, the engine cooling water is introduced, via the opening 44 in the upper half of the separation plate 39, into the vertical passageway 63 constructed by the openings 61 of the stacked plates 40. The engine cooling water in the passageway 63 is, then, introduced, via the openings 44 in the lower separation plate 39, into the water chamber 36 at the bottom of the cooler 1. The water in the chamber 36 is introduced, via the openings 45 in the lower separation plate 38, into water outlet, vertical passageway 64 constructed by the openings 62 of the stacked plates 40. The engine cooling water in the passageway 64 is discharged, via the openings 45 in the upper separation plate 39, into the water outlet chamber 13. The engine cooling water in the chamber 13 is, via the opening 15 in the first bracket 2, discharged to the water outlet pipe 12, and is returned to the water pump 209 for positive recirculation of the engine cooling water.

The engine cooling water in the heat exchanging passageways 63 constructed by the openings 61 in the stack of the heat exchanging plates 40 and the heat exchanging passageway 64 constructed by the openings 62 in the stack of the heat exchanging plates 40 flow along the direction (vertical direction in FIG. 3), which is transverse to the plane of the plates 40. The first oil in the heat exchanging passageway 68 constructed by the openings 65, the second oil in the second heat exchanging passageway 69 constructed by the openings 66 and the third oil in the third heat exchanging passageway 70 constructed by the openings 67 flow along the direction (horizontal direction in FIG. 3), which is parallel to the plane of the plates 40. Thus, heat exchange takes place between the vertical flows of the engine cooling water at a low temperature in the direction transverse to the plane of the plates 40, and the horizontal flows of the first, second and third oils in the direction which is parallel to the plane of the plates 40, so that a substantial reduction is obtained in the temperature of the first, second and third oils.

Figure 11:
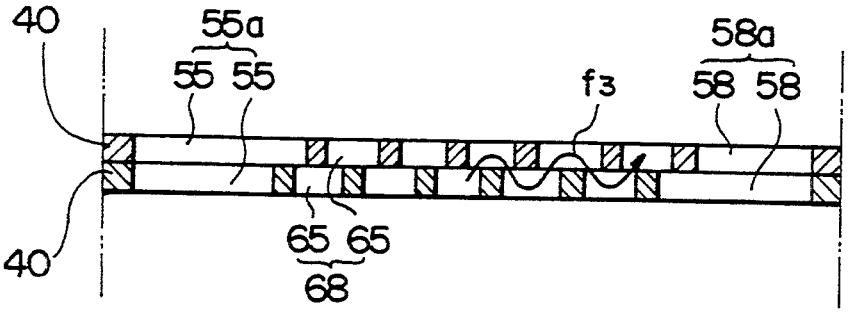
FIG. 11 is a cross sectional view taken along a line XI—XI in FIG. 10.

The flows of the oil in the passageways 68, 69 and 70 become somewhat zigzag, since the flows occur through openings 65 (66, 67) between vertically adjacent plates 40, as shown by an arrow $f_3$ in FIG. 11, thereby producing vortex in the flows of the oils, resulting in an increase in heat exchanging efficiency of the oils with respect to the cooling water.

In the above construction, vertical flows of the engine cooling water transverse to the paper of FIG. 9 occurs via the passageways 63 and 64 along the width of the stack of the heat exchanging plates 40. Contrary to this, horizontal flows of the first, second and third oil passageways 68, 69 and 70 occur along the length of the stack of plates 40. The flows of the first, second and third oils are neatly separated along the width of the plates 40 due to the provision of the separation walls 220 and 222 extending in parallel along the length of the oil cooler. As a result, an effective cooling of the three kinds of the oils by the engine cooling water can be obtained.

Furthermore, according to the present invention, any separate part is unnecessary for obtaining a separation of the flows between the first, second and third oils, which is effective for reducing the number of the parts constructing the oil cooler, thereby reducing the cost for manufacturing.

According to the first embodiment, the introduction of the oils into the oil cooler 1 is done from above, while the removal of the oils from the oil cooler is done from above, so that an "U" shaped flows of the oils are obtained. The cooling water as introduced executes, first, a heat exchange at the downwardly directed heat exchanging passageway 63, and the cooling water as removed executes, then, a heat exchange at the upwardly directed passageway 64. In other words, the temperature of the engine cooling water at the inlet side passageway 63 is higher than that at the outlet side passageway 64. The first oil in the heat exchanging passageway 68 executes a heat exchange mainly with the water of lower temperature in the-inlet side water passageway 63. The second oil in the heat exchanging passageway 69 executes a heat exchange with the water of lower temperature in the inlet side water passageway 63 as well as the water of higher temperature in the outlet side water passageway 64. Furthermore, the third oil in the heat exchanging passageway 70 executes a heat exchange mainly with the water of higher temperature in the outlet side water passageway 64. Thus, the first oil of the strongest requirement of the cooling is passed through the first heat exchanging passageway 68. The second oil of the medium requirement of the cooling is passed through the second heat exchanging passageway 69. Finally, the third oil of the weakest requirement of the cooling is passed through the third heat exchanging passageway 70.

Figure 12:
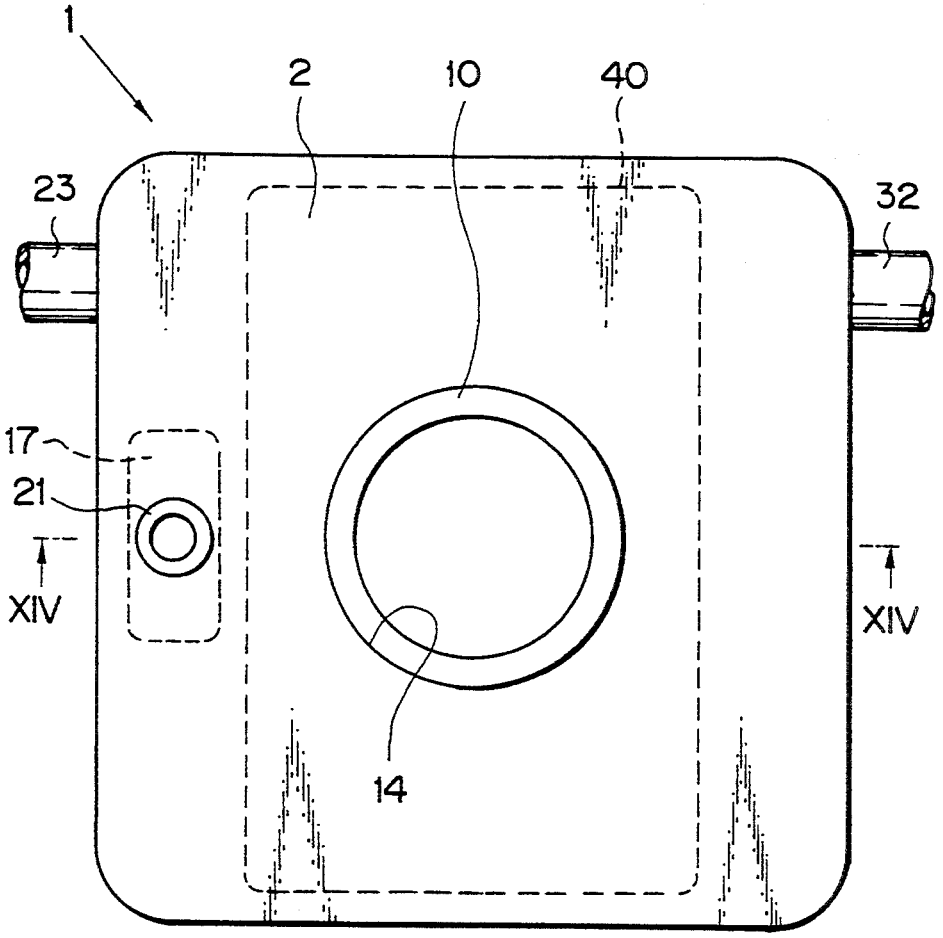
FIG. 12 is a plan view of an oil cooler in a second embodiment.
Figure 13:
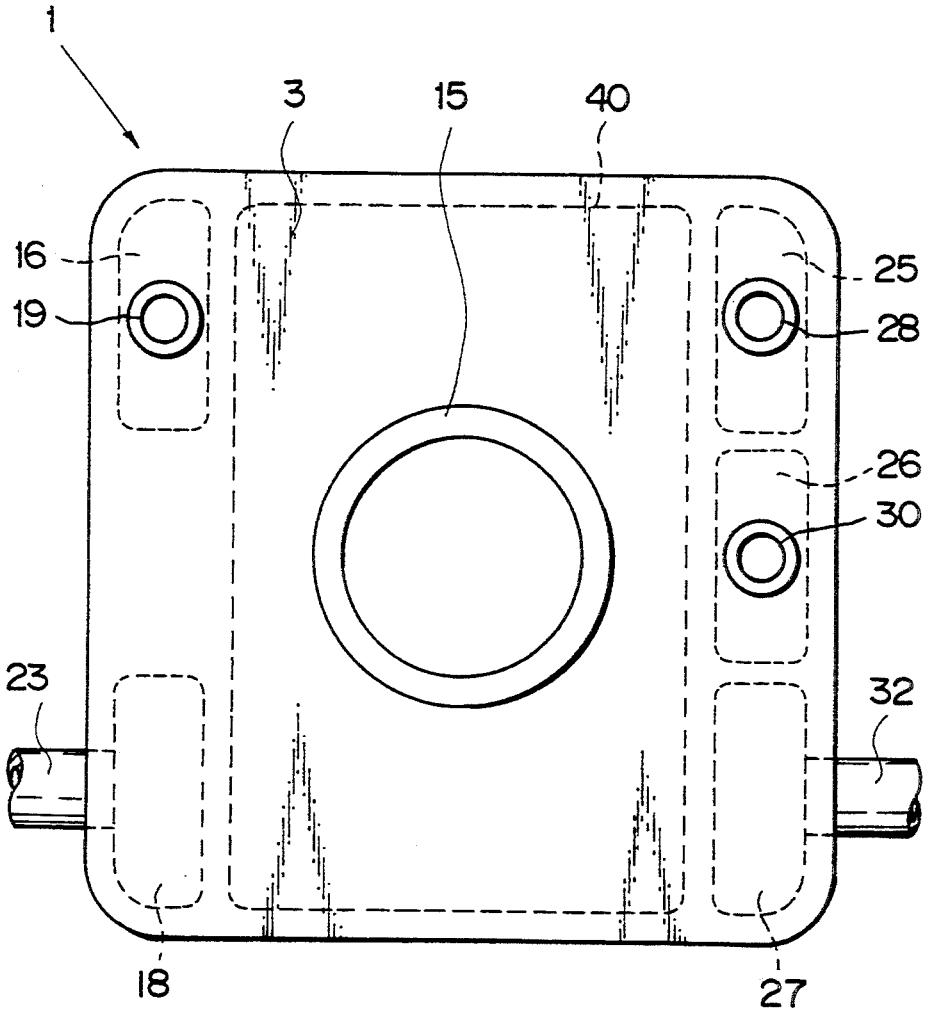
FIG. 13 is a bottom view of the oil cooler in FIG. 12.
Figure 14:
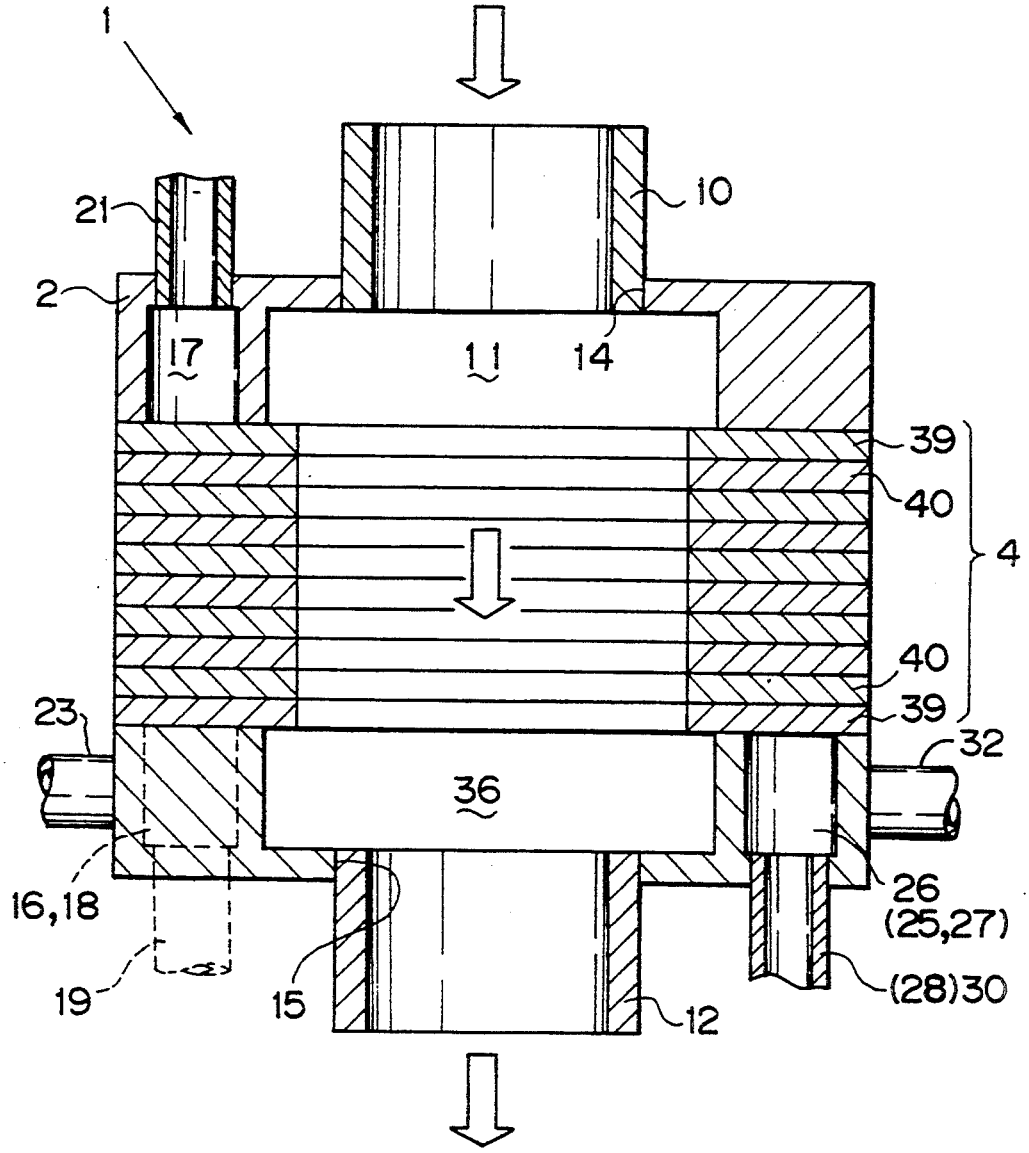
FIG. 14 is a cross sectional view taken along a line XIV—XIV in FIG. 12.

A second embodiment in FIGS. 12 to 14, a straight flow of the engine cooling water is employed instead of the U-shaped flow in the first embodiment. Namely, in the second embodiment, the upper separation plate 39 includes only an water inlet opening 14, to which the water introduction pipe 10 is connected, and only a water inlet chamber 11 is formed below the first bracket 2. Below the bottom separation plate 39, an oil outlet chamber 36 is created, to which the oil outlet opening 15 is opened, to which the oil outlet pipe 12 is connected. This straight flow arrangement is advantageous since the oil cooler 1 can be conveniently disposed in the line connecting the radiator 209 and the water pump 209.

As shown in FIG. 12, the first bracket 2 is, at its left hand side, formed with a recess which, together with the top separation plate 39, forms a the second oil inlet chamber 17. As shown in FIG. 13, the second bracket 3 is, at its left hand side, formed with two recess which, together with the bottom separation plate 39, forms a first oil inlet chamber 16 and a third oil inlet chamber 18, and is, at its right hand side, formed with three recesses, which, together with the bottom separation plate 39, form a first oil outlet chamber 25, the second oil outlet chamber 26 and the third oil outlet chamber 27.

Connected to the first bracket 2 is a second oil inlet pipe 21, so that it opens to the second oil inlet chamber 21. Connected to the second bracket 3 is first oil introduction pipe 19, so that it opens to the first oil inlet chamber 16, a third oil introduction pipe 23, so that it opens to the third oil inlet chamber 18, a first oil outlet pipe 28, so that it opens to the first oil outlet chamber 25, a second oil outlet pipe 30, so that it opened to the second oil outlet chamber 26, and a third oil outlet pipe 32, so that it opens to the third oil outlet chamber 27.

The construction of the heat exchanging unit 4 constructed by the top and bottom separation plates 39, and the stack of alternately, oppositely arranged heat exchanging plates 40 is the same as explained with those explained in the first embodiment, with reference to FIGS. 1 to 11.

In this embodiment, the direction of the flow of the first and second oil via the pipes 19 and 28, and 21 and 30 for introduction as well as a removal are vertical, as similar to the first embodiment. However, the direction of the flow of the third oil for the introduction and the removal via the pipes 23 and 32 is horizontal. As to the direction of the flow of the oils, as well as the position of the location of connection and direction, the first, second and third oil inlet pipes 19, 21 and 23, and oil outlet pipes 28, 30 and 32 can be suitably modified so as to conform to a particular requirement which arises when the oil cooler 1 is actually to be assembled in the vehicle.

Figure 15:
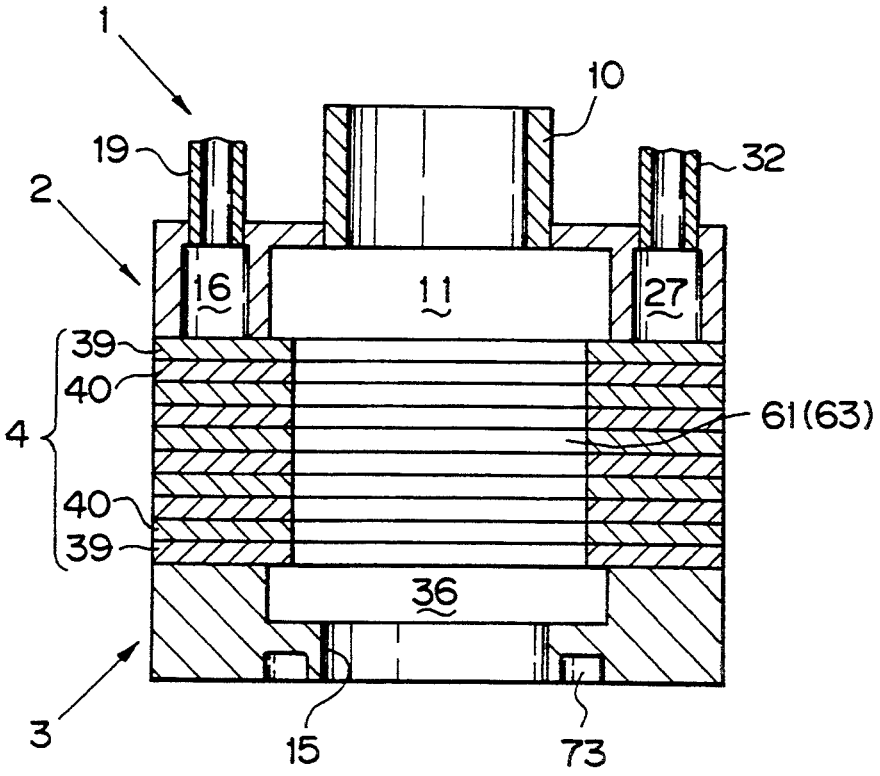
FIG. 15 is similar to FIG. 3 but shows a oil cooler in a third embodiment, which is adapted for a connection to an engine body.
Figure 16:
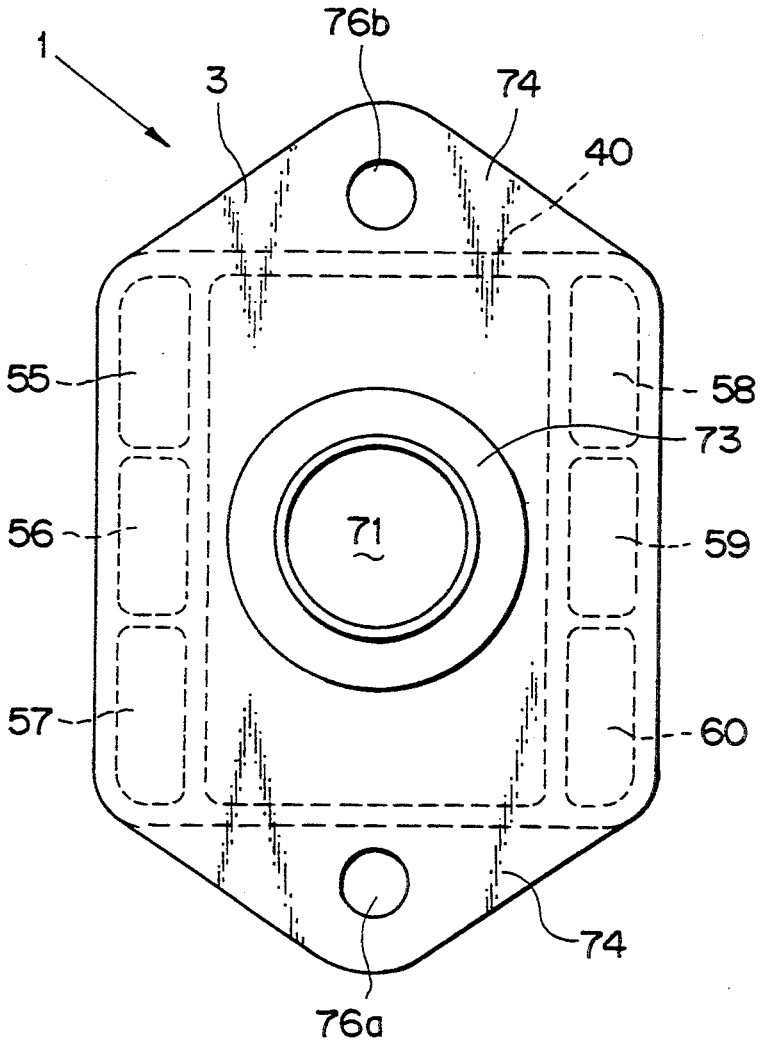
FIG. 16 is a bottom view of the oil cooler in FIG. 15.
Figure 17:
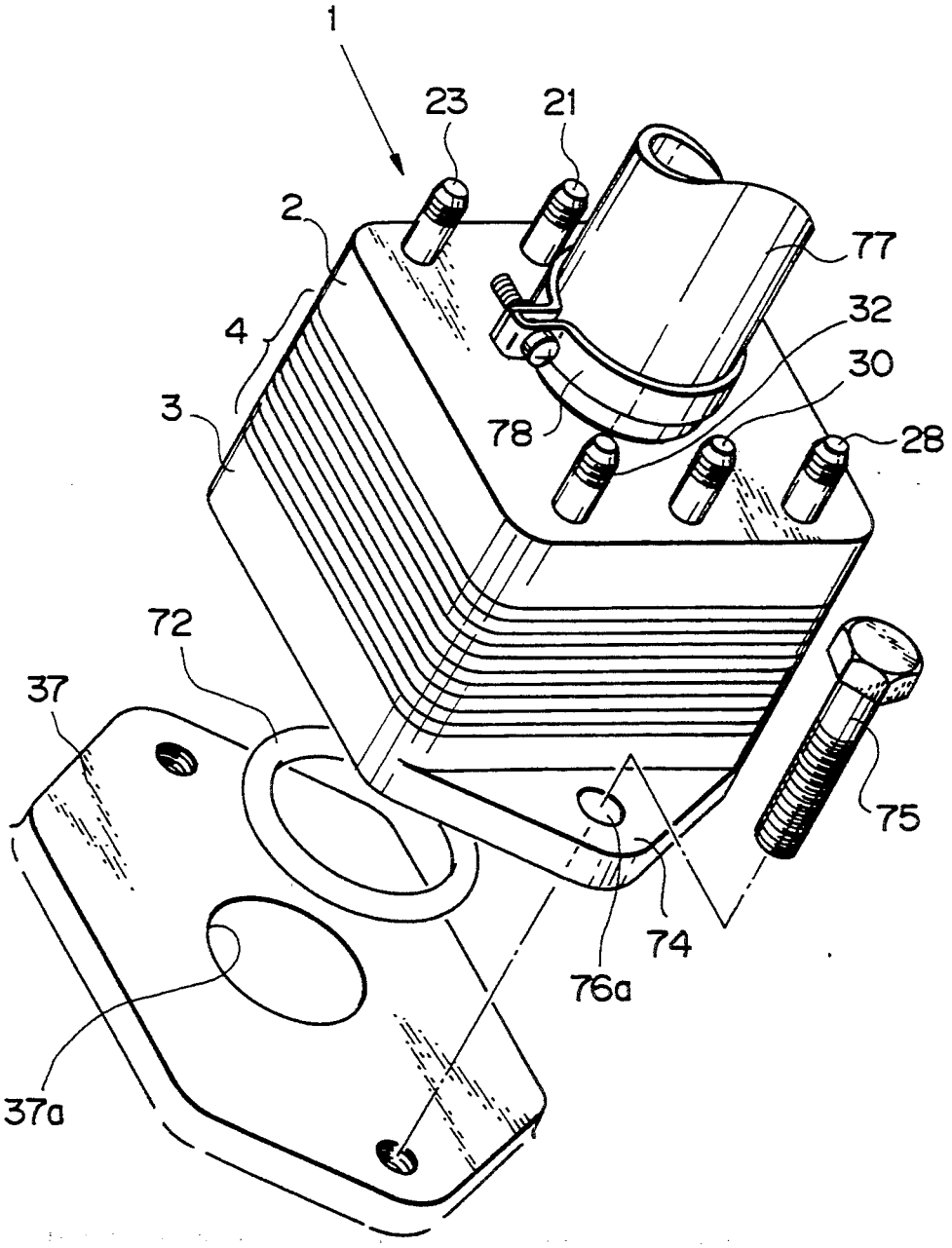
FIG. 17 is a perspective view of the oil cooler in FIG. 15 illustrating how it is connected to the engine body.

FIGS. 15 to 17 show a third embodiment of the present invention, which illustrates how the oil cooler according to the present invention is connected to a required location. The oil cooler 1 is a straight water flow type as illustrated in the second embodiment in FIGS. 12 to 14. Namely, the oil cooler 1 has, at its first bracket 2, a water inlet pipe 10 for introduction of the water from the radiator 208 in FIG. 1 into the water inlet chamber 11, and has, at its second bracket 3, an water outlet chamber 36 opened to an opening 71 for connection with the engine water pump 209 in FIG. 1. The second bracket 3 is, at its bottom end, further provided with an annular groove 73 located around the water outlet opening 71. The annular groove 73 is for receiving an O-ring 72 not shown in FIG. 15 but shown in FIG. 17. As shown in FIG. 16, the second bracket 3 is provided with opposite flange portions 74 extending along the direction of the length of the heat exchanging plates 40. The flange portions 74 are for connection of the oil cooler 1 to a suitable location 37 (FIG. 17) such as a block of the internal combustion engine. Namely, the flange portions 74 are formed with openings **76*a* and 76*b* (FIG. 16), to which bolts 75 are respectively inserted so that they are screwed to the connecting portion 37 of the engine block via the O-ring 72 to obtain a water tight connection of the engine cooler 1 with the engine block. In this connected state, the outlet opening 71 in FIG. 15 is connected to an opening 37*a* in the engine block, which opening 37*a* is in communication with the water pump not shown in FIG. 17. A rubber hose 77 (FIG. 17) is provided for connecting the water inlet pipe 10 with the radiator 208 in FIG. 1. As a result, the engine cooling water after the heat exchanging with the oils at the oil cooler 1** is introduced into the engine block for its cooling operation.

Figure 18:
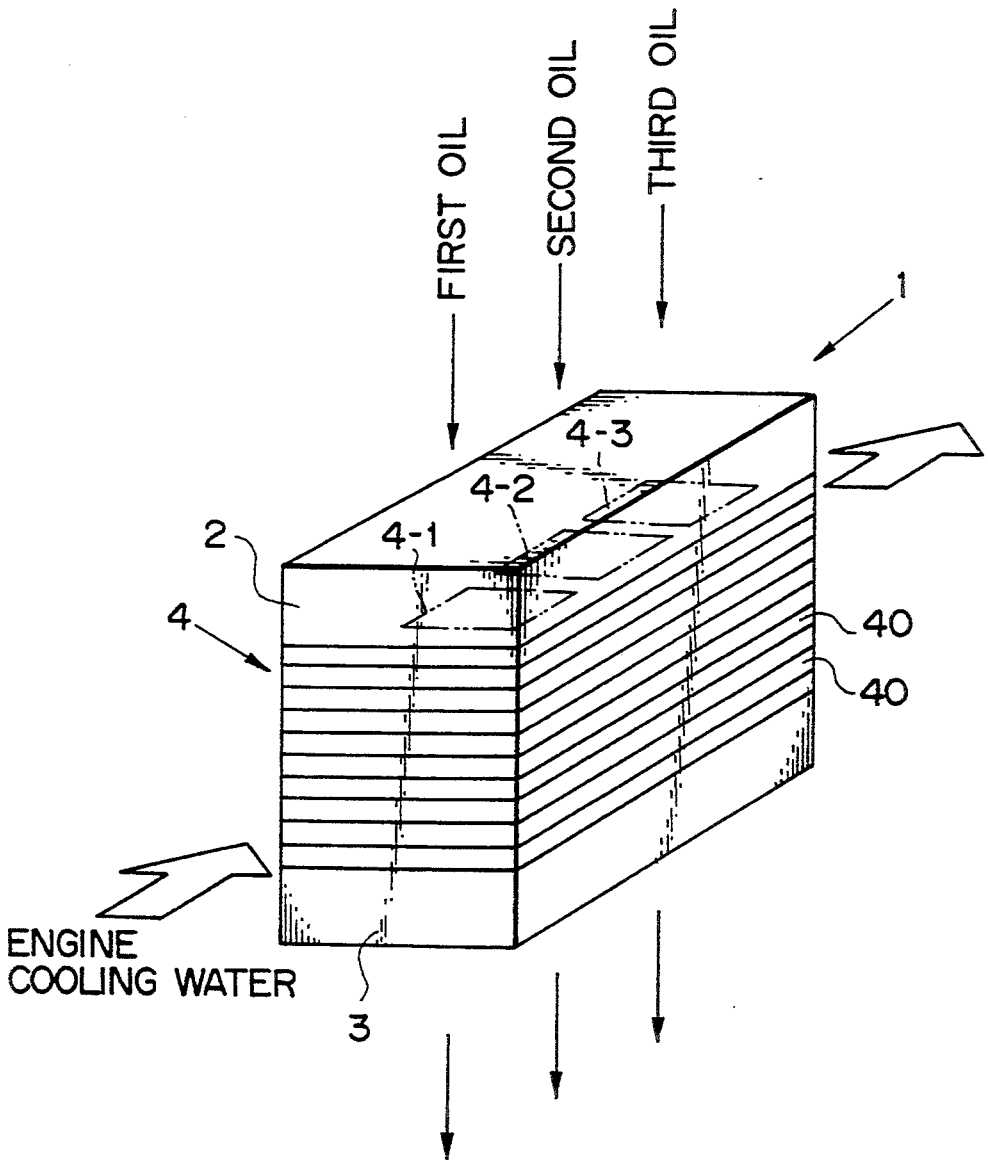
FIG. 18 is a schematic perspective view illustrating flows of water and oils in a fourth embodiment.

FIG. 18 shows schematically a fourth embodiment of the present invention, wherein the flows of the cooling water are horizontal along the plane of the heat exchanging plates 40, while the flows of the first, second and third oils are transverse to this plane. The heat exchanging units includes separate passageways 4-1, 4-2 and 4-3 to obtain separate flows of the first, second and third oils. As to the heat exchanging plates 39, their construction is substantially the same as that shown in FIG. 9. The water flows in a direction parallel to the plane of the plates 40 via the passageways formed by the asymmetric openings corresponding to those 65, 66 and 67 in FIG. 9 between the adjacent heat exchanging plates 40.

The above embodiments are directed to the water cooled oil cooler 1 which uses the engine cooling water for obtaining a cooling of the engine lubrication oil, the transmission oil and the power steering oil. However, the present invention is not limited to this particular application. Namely, the oil cooler of the present invention can be applied to any oil cooler when a such a requirement exist that different kinds of oils, such as the lubrication oil and operating oil, should be cooled by a single cooling medium, such as the engine cooling water.

In the above embodiments, the heat exchanging plate 40 forms a substantially rectangular shape. However, the heat exchanging plate 40 may have other shape, such as a circular shape, an elliptic shape, an elongated circular shape, or a polygonal shape.

The number of the heat exchanging plates as well as a length thereof are determined so that a desired heat emission efficiency is obtained by the oil cooler.

Furthermore, the shape, dimension and number of the first and second opening are not limited to those described in the specification, and are the factors which are adjusted to obtain a desired effect.

In the above embodiments, the heat exchanging plates having asymmetrical openings 65, 66 and 67 (FIG. 6) of the same construction are alternately reversed in the stack, so that the asymmetrical openings are in communication with each other to create the passageways 68, 69 and 70 to obtain the flows along a direction which is parallel to the plane of the heat exchanging plates. In place of this construction, the heat exchanging plates, which are adjacent with each other, can be of different shape of the second openings to create the passageways to obtain the flows along a direction which is parallel to the plane of the heat exchanging plates.

In the above embodiment, the oil cooler 1 is mounted to the engine block, as a location to be connected. However, the oil cooler can be connected to any other location, such as a lower tank of a radiator, a case of a water pump, or a body of a vehicle, which is considered appropriate for the particular use.

We claim:

1. A heat exchanging device comprising:

a stack of heat exchanging plates, each having first and second sets of openings;

said openings in said sets being arranged alternately along a direction in a plane of the plates;

said openings in said sets being in communication with each other between the stacked plates for creating first and second heat exchanging passageways, respectively, which are separated from each other;

said first heat exchanging passageways extending substantially transverse to the plane of the heat exchanging plates, while the second heat exchanging passageways extending substantially parallel to the plane of the heat exchanging plates;

one of the first and second heat exchanging passageways being for a passage of a cooling medium, while the other heat exchanging passageways being for a passage of a plurality of media to be subjected to a heat exchange with the cooling medium;

each of said heat exchanging plates being provided with spaced partitions for dividing said second heat exchanging passageways for the passage of the media to be cooled into separate groups, so that the media to be cooled separately flow in respective groups.

2. A heat exchanging device according to claim 1, wherein each of said heat exchanging plates forms a rectangular shape, each said second heat exchanging passageway is for the passage of the separate media to be cooled and extends in a direction of the length of heat exchanging plates, and said partitions extend along the length of plate and are spaced along the width of the plates, so that the second heat exchanging passageways are divided into said groups along the width of the heat exchanging plates.

3. A heat exchanging device according to claim 1, further comprising means for dividing the first heat exchanging passageway for the passage of the cooling medium into two, one being the cooling medium coming in, the other for the cooling medium going out.

4. A heat exchanging device according to claim 1, wherein the first heat exchanging passageway for the passage of the cooling medium is such that one way flow of the cooling medium is created.

5. A heat exchanging device according to claim 1, wherein said openings in said first set register with each other between the stacked plates, so that the openings in the first set create said first passageways which extend substantially transverse to the plane of the plates;

the openings in said second sets being slightly out of register with those in adjacent stacked plates while maintaining their communication, so that the openings in the second set create said second passageway substantially parallel to the plane of the plates.

6. A heat exchanging device according to claim 5, wherein said openings in said first set are symmetrical with respect to a central axis of the plate;

said openings in said second set form spaced rows of openings, the openings of respective rows being asymmetric with respect to said central axis of the plate;

the stack of the heat exchanging plates are such that the plates are alternately reversed, so that the symmetrical openings in the first set are in communication with each other to create said first heat exchanging passageway substantially transverse to the plane of the plates, and so that the asymmetric openings in the respective rows of openings in said second set are in communication with each other to create said second heat exchanging passageways substantially parallel to the plane of the plates.

7. A heat exchanging device comprising:

a stack of heat exchanging plates, each having a first and second set of openings;

said openings in said sets being arranged alternately along a direction in a plane of the plates;

said openings in said sets being in communication with each other between said stacked plates for creating first and second heat exchanging passageways, respectively, which are separate from each other;

said first heat exchanging passageways extending substantially transverse to the plane of the heat exchanging plates for a passage of a cooling medium, while the second heat exchanging passageways extending substantially parallel to the plane of the heat exchanging plates for passage of a plurality of media to be subjected to a heat exchange with the cooling medium;

each of said heat exchanging plates being provided with spaced partitions for dividing said second heat exchanging passageways for the passage of the media to be cooled into separate groups, so that the media to be cooled separately flow in the respective groups.

8. A heat exchanging device comprising:

a stack of heat exchanging plates, each having first and second sets of openings;

said openings in said sets being arranged alternately along a direction in a plane of the plates;

said openings in said sets being in communication with each other between said stacked plates for creating first and second heat exchanging passageways, respectively which are separate with each other;

said first heat exchanging passageways extending substantially transverse to the plane of the heat exchanging plates for a passage of different media to be cooled, while the second heat exchanging passageways extending substantially parallel to the plane of the heat exchanging plates for passage of a cooling medium;

each of heat exchanging plates being provided with spaced partitions for dividing said first heat exchanging passageways for the passage of the media to be cooled into separate groups, so that the media to be cooled separately flow in the respective groups.

9. A cooler for cooling different kinds of media to be cooled independently by a cooling medium, comprising:

a stack of heat exchanging plates, each having first and second sets of openings;

said openings in said sets being arranged alternately along a direction in a plane of the plates;

said openings in said sets being in communication from each other between the stacked plates for creating first and second heat exchanging passageways, respectively, which are separated from each other;

said first heat exchanging passageways extending substantially transverse to the plane of the heat exchanging plates, while the second heat exchanging passageways extending substantially parallel to the plane of the heat exchanging plates;

the first heat exchanging passageways being for a passage of the cooling medium, while the second heat exchanging passageway being for passages of the media to be cooled;

each of heat exchanging plates being provided with spaced partitions for dividing said second heat exchanging passageways for the passage of the media to be cooled into separate groups, so that the media to be cooled separately flow in the respective groups;

a pair of separating plates between which said stack of the heat exchanging plates is sandwiched, the separating plates having a third set of openings in communication only with the first set of the openings constructing the first passageway, and fourth set of openings in communication only with the second set of the openings constructing the second passageway;

inlet and outlet means for introducing the cooling medium into the first passageway and for taking out the cooling medium, via said third set of the opening in the separating plates, and;

inlet and outlet means for the media to be cooled for introducing the media to be cooled separately into the second passageway at respective groups, and for taking out the media to be cooled from the second passageway at respective groups, whereby the media to be cooled in the second passageway at the respective groups are cooled under a heat exchange with the flow of the cooling medium in the first passageway.

* * * * *